US006610937B2

(12) United States Patent
Yamaguchi

(10) Patent No.: US 6,610,937 B2
(45) Date of Patent: Aug. 26, 2003

(54) OPERATING DEVICE HAVING STATIC ELIMINATOR AND ELECTRONIC APPARATUS HAVING OPERATING DEVICE

(75) Inventor: Toshinobu Yamaguchi, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/102,707

(22) Filed: Mar. 22, 2002

(65) Prior Publication Data

US 2002/0144882 A1 Oct. 10, 2002

(30) Foreign Application Priority Data

Apr. 6, 2001 (JP) ..... 2001-108558

(51) Int. Cl.[7] ..... H01H 9/00; H01H 19/00; H01H 25/04; H05F 25/04

(52) U.S. Cl. ..... 200/4; 200/11 R; 200/305

(58) Field of Search ..... 200/4, 11 R, 117 W, 200/305; 361/212, 220

(56) References Cited

U.S. PATENT DOCUMENTS 3,566,049 A * 2/1971 Wright ..... 200/14
4,196,324 A * 4/1980 Kojima et al. ..... 200/11 DA
5,401,926 A * 3/1995 Aoyama et al. ..... 200/305
5,886,310 A * 3/1999 Kataoka et al. ..... 200/4
5,952,628 A * 9/1999 Sato et al. ..... 200/4
6,020,563 A * 2/2000 Risk, Jr. ..... 200/61.54
6,229,103 B1 * 5/2001 Yamamoto et al. ..... 200/4
6,236,002 B1 * 5/2001 Chou ..... 200/4

* cited by examiner

*Primary Examiner*—J. R. Scott
(74) *Attorney, Agent, or Firm*—Fitzpatrick, Cella, Harper & Scinto

(57) ABSTRACT

An operating device having a static eliminator capable of effectively grounding any static electricity surge through a switch operating button to exterior frame members or to ground within an electronic apparatus, and an electronic apparatus having such an operating device, comprises a rotatable dial for selecting one operation mode from among a plurality of modes, a button disposed in a recess portion in the center of the dial for pushing a switch located in the recess portion at the lower position of the dial, a rotary conductive member disposed within the recess portion provided in the center of the dial and capable of rotating together with the dial, and a fixed conductive member held by a base member for holding the dial. The rotary conductive member and the fixed conductive member are kept in constant contact.

7 Claims, 3 Drawing Sheets

OPERATING DEVICE HAVING STATIC ELIMINATOR AND ELECTRONIC APPARATUS HAVING OPERATING DEVICE

BACKGROUND OF THE INVENTION

1. Field of the Invention

The present invention relates to an operating device having a static eliminator, and to an electronic apparatus having the operating device.

2. Description of the Related Art

It is known in the related art that an electronic apparatus, such as a camera, usually has a switch button in the center of a dial provided for selecting a plurality of operation modes, so that it is possible to make the electronic apparatus compact and improve its operational performance.

FIG. 3 is a cross sectional view showing an example of a conventional dial device.

As shown in FIG. 3, the conventional dial device comprises a dial 51, and a base member 52 for holding the dial 51. A brush plate 53, which rotates together with the dial 51 and is provided with a brush 53*a*, can be brought into contact with patterns formed on a flexible plate 54 so as to select one mode of operation from among a plurality of modes. A button 55 slides up and down along the center axis of the dial 51, by virtue of a center shaft 55*a*, so as to contact a contact switch 57, and is urged upward by a spring 56. Claw portions 55*b* and 55*c* serve as retaining means for preventing the button 55 from sliding off the dial device. Reference numerals 58 and 59 represent frame members that support an electronic apparatus carrying the dial device.

On the other hand, since the trend in recent years has been to make electronic apparatuses compact, it is required that the dial be made as small as possible. Furthermore, in most cases the dial, as well as the button, are made of plastic which is an insulating material.

When the surfaces of the dial and the button get close to the brush and the contact switch, static electricity borne on the body of a human operator will surge into the electronic apparatus through the surfaces of the brush and the contact switch, which are both made of an insulating material, thus adversely and undesirably affecting internal electronic circuitry of an electronic apparatus.

The present invention has been made in view of the above, and an object of the present invention is to provide an improved dial device having a static eliminator capable of allowing any static electricity which surges through the button to escape to ground. Another object of the invention is to provide an electronic apparatus equipped with such an improved dial device.

SUMMARY OF THE INVENTION

In order to achieve the above objects, a first embodiment of an operating device of the present invention comprises a dial, a rotary conductive member rotatable together with the dial, and a fixed conductive member fixed in an electronic apparatus holding the operating device and in contact with the rotary conductive member.

In another aspect, the present invention relates to an electronic apparatus containing an operating device which comprises a dial, a rotary conductive member rotatable together with the dial, and a fixed conductive member fixed in the electronic apparatus holding the operating device and in contact with the rotary conductive member.

In a further aspect, the present invention relates to an operating apparatus comprising a dial, an operating button provided in a recess portion of the center of the dial, a rotary conductive member engaged between the recess portion of the center of the dial and the operating button, and having a strip projecting from the recess portion of the center of the dial and a fixed circular conductive member provided in an electronic apparatus holding the operating device, and disposed between the dial and the electronic apparatus with the center of the dial serving as its center axis, so as to make contact with the strip of the rotary conductive member.

In still a further aspect, the present invention relates to an electronic apparatus having an operating device which comprises a dial, an operating button provided in a recess portion of the center of the dial; a rotary conductive member engaged between the recess portion of the center of the dial and the operating button, and having a strip projecting from the recess portion of the center of the dial; and a fixed circular conductive member provided in an electronic apparatus holding the operating device, and disposed between the dial and the electronic apparatus with the center of the dial serving as its center axis, so as to make contact with the strip of the rotary conductive member.

Further objects, features and advantages of the present invention will become apparent from the following description of the preferred embodiments with reference to the attached drawings.

DESCRIPTION OF THE PREFERRED EMBODIMENTS

Preferred embodiments of the present invention will be described with reference to the accompanying drawings.

Figure 1:
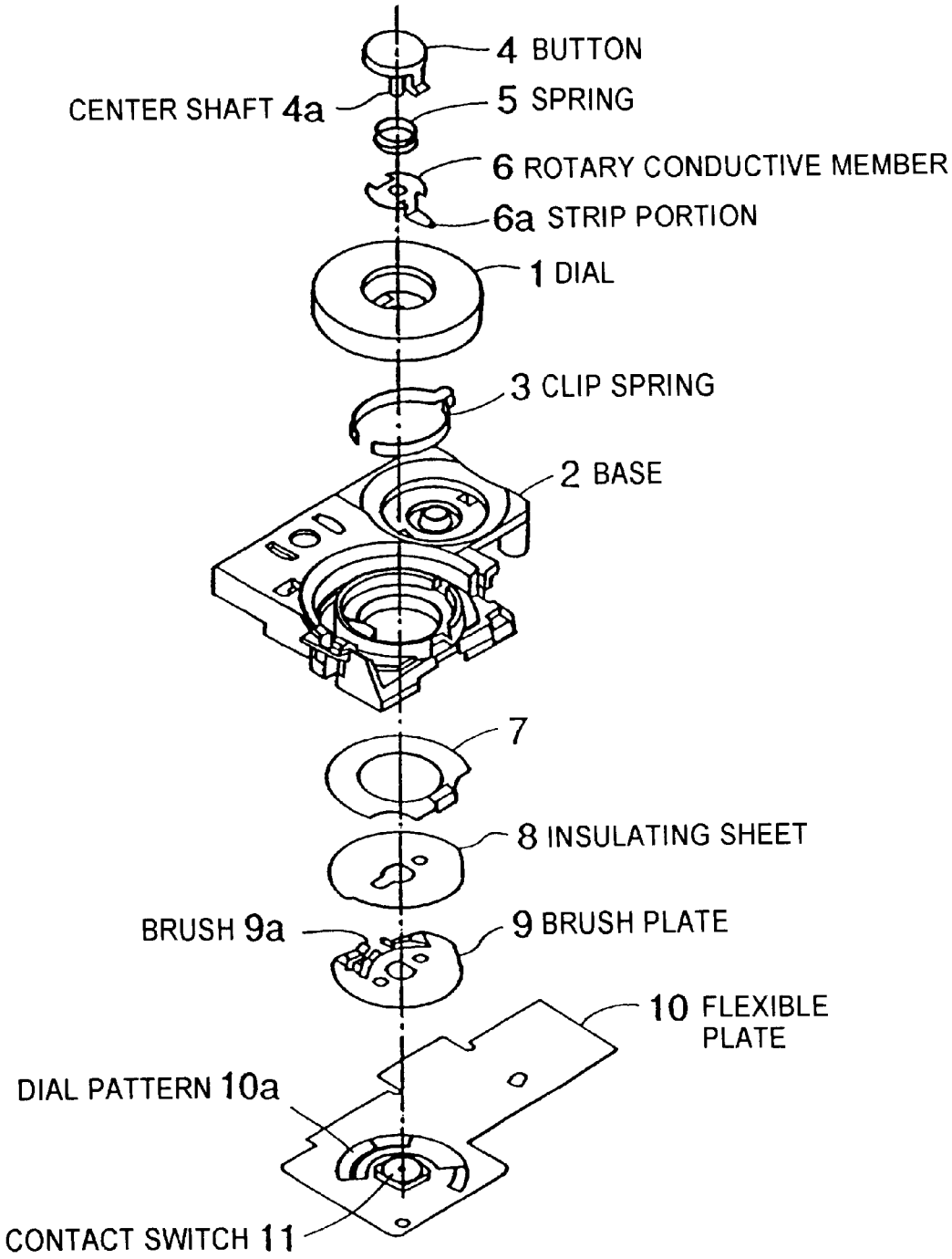
FIG. 1 is an exploded perspective view showing important elements of a dial device having a static eliminator constructed according to an embodiment of the present invention.
Figure 2:
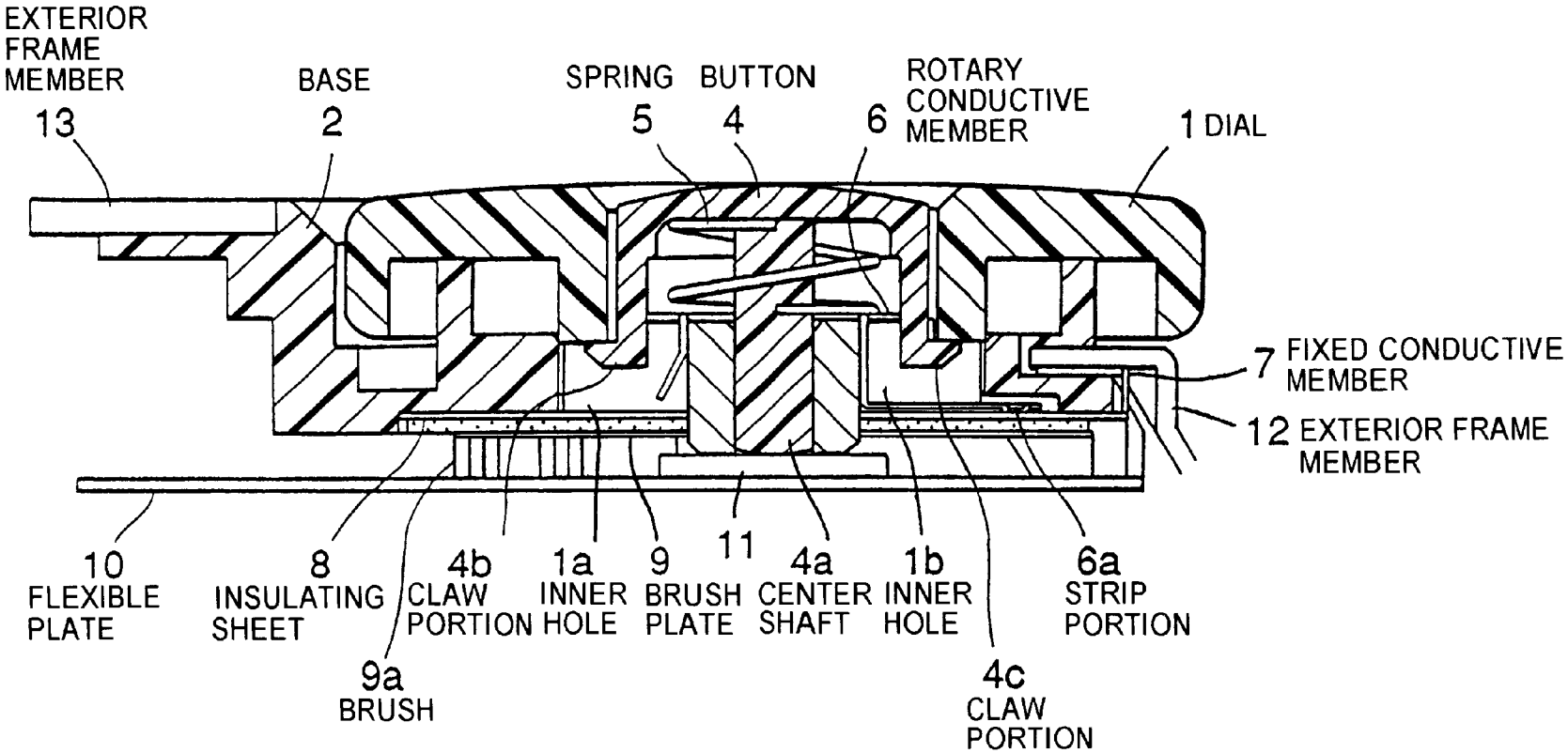
FIG. 2 is a cross sectional view showing an important portion of the dial device having the static eliminator constructed according to the present embodiment.
Figure 3:
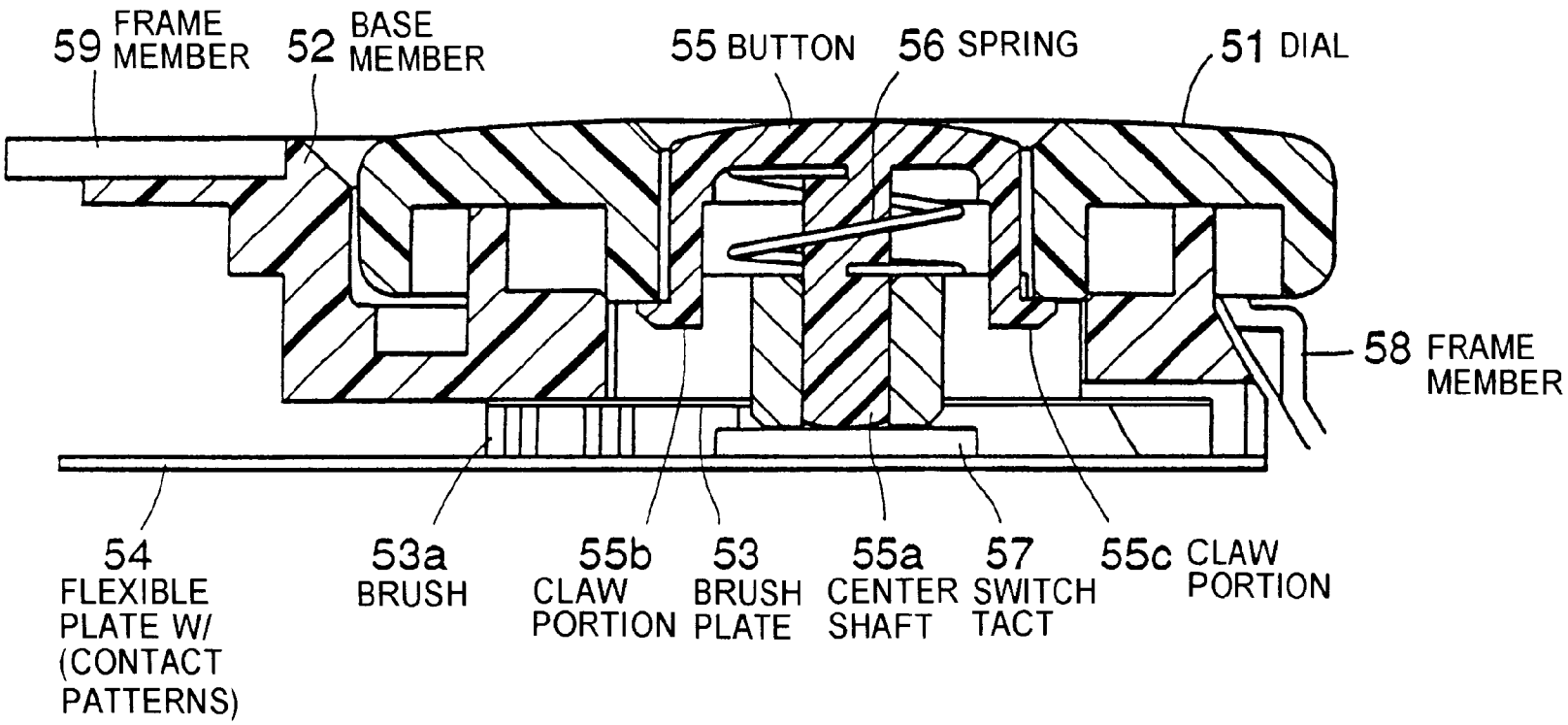
FIG. 3 PRIOR ART
FIG. 3 is a cross sectional view showing an example of a conventional dial device.

FIG. 1 is an exploded perspective view showing important elements of a dial device having a static eliminator constructed according to an embodiment of the present invention. FIG. 2 is a cross sectional view showing an important portion of the dial device having the static eliminator constructed according to the present embodiment.

Referring to FIG. 1 and FIG. 2, the dial device includes a dial 1 that switches-over operation among a plurality of modes, a base 2 that holds the dial 1, and a clip spring 3 for clipping the dial 1 in the base 2 at a predetermined angle.

A button 4 for pushing a contact switch 11 is disposed at a lower position of the dial and located at a central recess portion of the dial. The button 4 has a center shaft 4*a* which is engaged in a shaft hole formed in the center of the dial 1, in a manner such that the center shaft 4*a* can slide freely up and down in the vertical direction. In this way, the button 4 may be urged in an upward direction by a spring 5. Further, claw portions 4*b* and 4*c* of the button 4 are inserted into inner recesses la and 1*b* formed within the dial 1, thereby preventing a possible parting of the button 4 from its correct position.

On the other hand, a rotary conductive member 6 is received at the bottom of a central recess portion of the dial 1, and includes a strip portion 6*a* that passes down through the inner recess 1*b* and then radially outward, so as to be disposed under the dial. The width of the strip portion 6*a* is substantially the same as the width of the inner recess 1*b* of the dial 1. In this way, since the rotary conductive member 6 is urged by the spring 5 so as to be pressed against the dial 1, it can rotate along with rotation of the dial 1.

A fixed conductive member 7 having a circular shape with a hollow center is provided with the center of the dial 1 serving as its axis. The fixed conductive member 7 is fixed on the base member 2. An insulating sheet 8 and a brush plate 9 carrying a brush 9*a* are provided to interpose and thus fix the base member 2 and the fixed conductive member 7 in the dial 1 by means of screws (not shown), thereby insulating the fixed conductive member 7 from the brush plate 9. In such an arrangement, even if the strip portion 6*a* rotates due to rotation of the dial 1, the strip portion 6*a* of the rotary conductive member 6 located on the underside of the dial 1 can be kept in constant contact with the fixed conductive member 7.

Further, there is provided a flexible plate 10 which has a dial pattern 10*a* and a contact switch 11, so that the brush 9*a* provided on the brush plate 9 can be brought into contact with the dial pattern la by rotation of the dial 1, thereby switching-over, for example, an image pickup mode of an electronic camera.

Moreover, there are provided exterior frame members 12 and 13, which are made of metal and together form a frame structure. Specifically, the exterior frame member 12 is formed so that it can be brought into contact with the fixed conductive member 7.

With the use of the above-described arrangement, any static electricity surging through the gap between the button 4 and the dial 1 is allowed to flow to the rotary conductive member 6. In this way, since the rotary conductive member 6 is in contact with the fixed conductive member 7 which in turn is in contact with the exterior frame member 12, any static electricity surge is allowed to flow to the exterior member (ground), thereby preventing a static electricity surge from flowing to the internal electronic circuit.

Furthermore, a static electricity surge through a clearance between the dial 1 and the base member 2 is allowed to flow at first to the fixed conductive member 7 and then to the exterior frame member 12. At this time, a static electricity flowing to the outside of the base member 2 will of course flow to the exterior frame members 12 and 13.

Although the above-described constitution has shown that a static electricity surging into an apparatus can be guided to metallic exterior members forming a frame structure, it is also possible to form another structure in which such static electricity is guided to a metallic chassis which is disposed within the apparatus and serves as a ground for the electric circuit of the apparatus.

As described above, according to the present invention, if an electrically conductive member is disposed on the bottom of a button provided for operating a switch and is caused to rotate together with the dial, and if the electrically conductive member is caused to come into contact with a grounded member disposed on the base member for holding the dial, static electricity surging into the electronic apparatus from the dial or from the button provided within the dial can be effectively guided to the exterior members or to ground within the apparatus, thereby ensuring protection of the internal electronic circuit.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An operating device for an electronic apparatus, said operating device comprising:

a rotatable dial;

a rotary conductive member rotatable together with said rotatable dial; and a fixed conductive member disposed in contact with said rotary conductive member so that static electricity applied to the electronic apparatus flows through said fixed conductive member for grounding away from switching circuitry of the electronic apparatus.

2. An electronic apparatus comprising:

a body; and an operating device according to claim 1, said operating device being mounted on said body.

3. An operating apparatus for an electronic apparatus, said operating apparatus comprising:

a rotatable dial having a recess portion at the center of said dial;

a button provided in the recess portion of the center of said dial;

a rotary conductive member engaged between the recess portion of the center of said dial and the button, and having a strip projecting radially outward from the recess portion of the center of said dial; and a fixed circular conductive member disposed between said dial and the electronic apparatus with the center of said dial serving as its center axis, so as to contact the strip of said rotary conductive member and so that static electricity applied to the electronic apparatus flows through said fixed circular conductive member for grounding away from switching circuitry of the electronic apparatus.

4. An electronic apparatus comprising:

a body; and an operating apparatus according to claim 3, mounted on said body.

5. An electronic apparatus comprising:

a rotatable dial;

a brush plate rotated by said rotatable dial;

a rotary conductive member rotated by said rotatable dial; and a fixed conductive member in contact with said rotary conductive member and insulated from said brush plate so that static electricity applied to said electronic apparatus passes via said rotary conductive member to said fixed conductive member and away from said brush plate.

6. An operating device according to claim 1, wherein the electronic apparatus comprises an exterior frame member that contacts said fixed conductive member to receive the static electricity for grounding.

7. An operating device according to claim 1, wherein the electronic apparatus comprises a metallic chassis disposed within the electronic apparatus, the metallic chassis receiving the static electricity passing through said fixed conductive member for grounding.

* * * * *

UNITED STATES PATENT AND TRADEMARK OFFICE

CERTIFICATE OF CORRECTION

PATENT NO. : 6,610,937 B2
DATED : August 26, 2003
INVENTOR(S) : Toshinobu Yamaguchi It is certified that error appears in the above-identified patent and that said Letters Patent is hereby corrected as shown below:

Column 3,
Line 22, "pattern 1a" should read -- pattern 10a --.

Signed and Sealed this

Third Day of February, 2004

JON W. DUDAS
*Acting Director of the United States Patent and Trademark Office*